US007396118B2

(12) United States Patent
Ogawa et al.

(10) Patent No.: US 7,396,118 B2
(45) Date of Patent: Jul. 8, 2008

(54) CARTRIDGE FOR INK JET RECORDING AND METHOD FOR PRODUCING THE SAME

(75) Inventors: Masashi Ogawa, Kawasaki (JP); Wataru Takahashi, Kawasaki (JP); Hiromasa Anma, Kawasaki (JP); Yasuo Kotaki, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 328 days.

(21) Appl. No.: 11/174,566

(22) Filed: Jul. 6, 2005

(65) Prior Publication Data

US 2006/0007286 A1 Jan. 12, 2006

(30) Foreign Application Priority Data

Jul. 9, 2004 (JP) ..... 2004-203283

(51) Int. Cl.
*B41J 2/175* (2006.01)

(52) U.S. Cl. ..... 347/87; 347/86

(58) Field of Classification Search ..... 347/86, 347/87

See application file for complete search history.

(56) References Cited

U.S. PATENT DOCUMENTS 5,567,373 A 10/1996 Sato et al. ..... 264/112
5,583,549 A 12/1996 Ujita et al. ..... 347/86
5,589,862 A 12/1996 Ujita et al. ..... 347/87
5,619,237 A 4/1997 Inoue et al. ..... 347/86
5,619,239 A 4/1997 Kotaki et al. ..... 347/86
5,781,213 A 7/1998 Ujita et al. ..... 347/86
6,070,974 A 6/2000 Kotaki et al. ..... 347/86
6,086,192 A * 7/2000 Kurata et al. ..... 347/86
6,113,230 A 9/2000 Ishinaga et al. ..... 347/86
6,145,975 A 11/2000 Kotaki et al. ..... 347/87
6,170,939 B1 1/2001 Ujita et al. ..... 347/86
6,220,701 B1 * 4/2001 Umemura ..... 347/86
6,234,618 B1 5/2001 Yamamoto et al. ..... 347/86
6,243,116 B1 6/2001 Kotaki et al. ..... 347/86
6,250,750 B1 6/2001 Miyazawa et al. ..... 347/87
6,336,709 B1 1/2002 Inoue et al. ..... 347/49
6,361,158 B1 3/2002 Inoue et al. ..... 347/86

(Continued)

FOREIGN PATENT DOCUMENTS

JP 9-94973 4/1997

(Continued)

*Primary Examiner*—Anh T. N. Vo
(74) *Attorney, Agent, or Firm*—Fitzpatrick, Cella, Harper & Scinto

(57) ABSTRACT

The present invention provides a method for producing an ink jet recording cartridge provided with a recording element substrate on the bottom surface, wherein the cartridge can be integrated with the recording element substrate precisely without causing any damage on the substrate, has a high barrier capacity, and can work with various inks and wherein such characteristics of the cartridge are provided by including the steps of pressing a lid to the upper opening of an ink-holding container made of a resin material including glass fibers to cover the opening, and vibration welding the lid to the container where means for holding the lid is vibrated in the direction along the top surface of the container.

5 Claims, 11 Drawing Sheets

U.S. PATENT DOCUMENTS

| | | | | |
|---|---|---|---|---|
| 6,419,350 | B1 | 7/2002 | Abe et al. | 347/86 |
| 6,467,889 | B1 * | 10/2002 | Miyazaki et al. | 347/86 |
| 6,554,413 | B2 * | 4/2003 | Kubota | 347/87 |
| 6,827,431 | B2 | 12/2004 | Kitabatake et al. | 347/86 |
| 7,234,803 | B2 * | 6/2007 | Amma et al. | 347/86 |
| 2002/0167575 | A1 | 11/2002 | Kitabatake et al. | 347/86 |
| 2003/0117468 | A1 | 6/2003 | Inoue et al. | 347/86 |
| 2006/0044371 | A1 | 3/2006 | Inoue et al. | 347/85 |

FOREIGN PATENT DOCUMENTS

| | | |
|---|---|---|
| JP | 10-16244 | 1/1998 |
| JP | 10-16249 | 1/1998 |
| JP | 2887058 | 2/1999 |
| JP | 2003-25603 | 1/2003 |

* cited by examiner

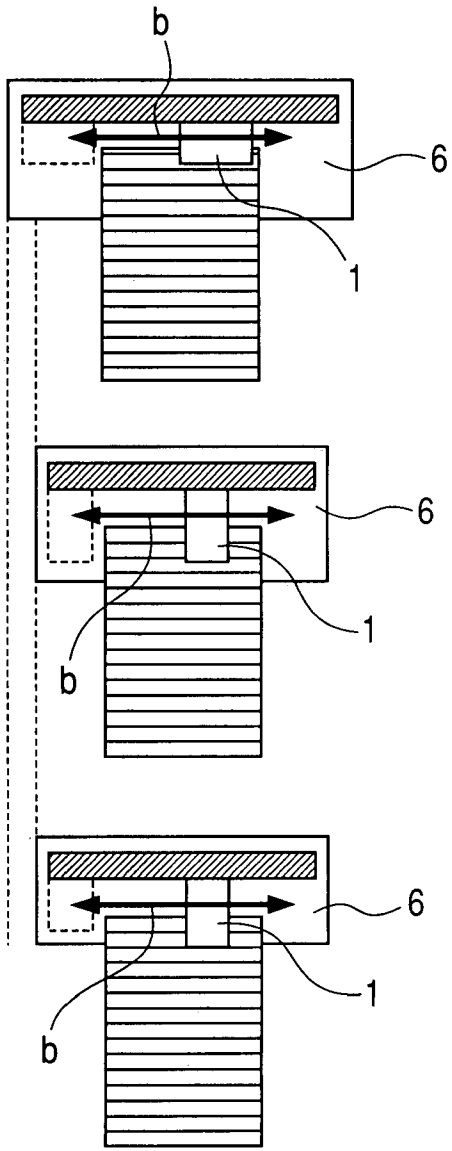
FIG. 3B
FIG. 3D
FIG. 3F
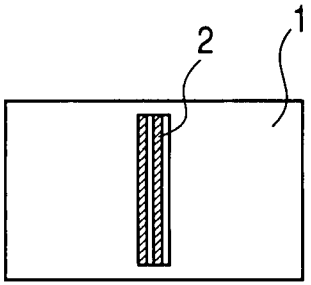
FIG. 3A
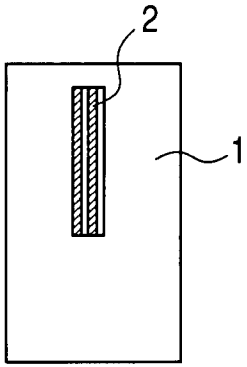
FIG. 3C
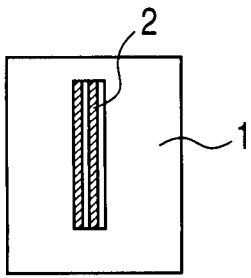
FIG. 3E

CARTRIDGE FOR INK JET RECORDING AND METHOD FOR PRODUCING THE SAME

BACKGROUND OF THE INVENTION

1. Field of the Invention

The present invention relates to an ink jet recording cartridge in which an ink tank for holding an ink and a recording element substrate for discharging the ink are integrated, and to a method for producing the same.

2. Related Background Art

Recently, ink jet recording devices have been able to make finer ink droplets to meet higher-quality images, and is also required to print at a higher speed. As a result, the number of ink-discharging nozzles has been greatly increasing to meet these requirements. Increasing the nozzle number needs larger recording element substrates. Therefore, a recording element substrate, which includes passages for a recording solution, e.g., ink, to be directed towards nozzles, has an increased volume for hollow portions. At the same time, the ink composition is advancing year by year for improving color-developing capacity, light resistance or the like. Along with these developments, resin materials for ink jet recording devices are also required to have improved properties. Some of the resins now being developed include those for precision molding to precisely mount recording element substrates in ink jet recording cartridges in which an ink tank for holding an ink and recording element substrate for discharging the ink are integrated, those containing a smaller quantity of solute to prevent aging of ink, and those of higher barrier capacity, e.g., those including glass fibers, to prevent evaporation of ink.

The process of producing ink jet recording cartridges employs bonding such as adhesion, thermal calking and the like. Of these, a most commonly used method is ultrasonic welding, in which resin parts closely contacted by a jig are ultrasonically vibrated by a horn of aluminum or titanium to generate frictional heat, by which they are molten in the interface and fast bonded to each other, and then cooled, on account of its various advantages, e.g., capacity of bonding in a short time, and high precision, reproducibility, tightness and strength of the weld. For production of an ink jet recording cartridge having features shown in FIG. 1, the lid 7 pressed to the fixed ink tank 4 is subjected to vibration in the pressing direction (vertical vibration) to bond them to each other, because a production system can oscillate the lid 7 more easily in the pressing direction than in any other direction. In this case, the recording element substrate 2 is vibrated along (in parallel to) the ink discharging direction.

FIG. 13 outlines the ink discharging structure of the recording element substrate 2, provided on the bottom surface of the ink jet recording cartridge 1 having the ink tank 4, where 51: ink supply port, 52: heating element which generates energy needed for discharging an ink, 53: ink passage, 54: ink-discharging port, and 55: ink-discharging port plane. As shown, an ink is discharged in the direction, designed at a right angle to the plane 55 of the ink-discharging port.

However, ultrasonic welding causes problems, when used for the ink tank made of a noryl-based resin compounded with around 25% of glass filler for improved barrier capacity, described above. In the production step for bonding the lid to the ink tank to which the recording element substrate has been attached, high-frequency (20 kHz) vertical vibration, applied by the conventional method to the lid 7 in the pressing direction, is transmitted to the director 9 and, in turn, to the outer peripheries of the ink tank 4 of a filler-containing material, with the result that the bottom surface of the ink tank 4 oscillates at a high frequency. The vibration is further transmitted to the recording element substrate 2 attached to the bottom surface of the ink tank 4, to oscillate, at a high frequency, the ink discharging structures, e.g., a number of the ink passages 53 having hollows in the order of several tens to several hundreds microns and ink-discharging port plane 55 in the direction perpendicular to the ink-discharging port plane 55, i.e., in the ink discharging direction (arrowed direction shown in FIG. 13). Therefore, the vibration can fatally crack these structures and recording element substrate 2 itself.

A recording element substrate is the most important and expensive of the components of an ink jet recording cartridge. The method which can cause defects, e.g., cracks, in the substrates in the final stage of the cartridge production process will make it difficult to supply the cartridges to the users at a reasonable price.

One approach against cracking to reduce the defects is to increase a vertical vibration frequency to 40 kHz in order to halve the amplitude at the horn tip. However, it is impossible to completely avoid the cracking by increasing the frequency, because the gravity acting on the ink discharging structure, including the hollows, changes little whether the frequency is 20 or 40 kHz.

Use of ultrasonic horizontal vibration, as disclosed by Japanese Patent Application Laid-Open No. H10-16244, is one approach. This method takes out horizontal vibration from the side of a horn designed to vertically oscillate for ultrasonic welding. In the horn 62 shown in FIG. 14, the vertical vibration from the booster 61 oscillates the side 63 of the horn 62 in the horizontal direction, to be transmitted to the work 64. The vibration decay from the horizontal vibration 65 to the horizontal vibration 66 as it moves from the side 63 to the center 62. This limits applicability of this method to a practical part size of 10 mm or so (length of the welded region). In other words, it is applicable to very small parts, e.g., recording element substrate, as described in the patent document. When applied to ink tank production, the method may not secure a sufficient strength of the welded interface, resulting from uneven welding.

The vibration welding method disclosed by Japanese Patent Application Laid-Open No. H09-94973 is developed for production of ink tanks of large size and complex shape. The method disclosed by Japanese Patent Application Laid-Open No. H10-16249 is not intended to bond an electronic part, e.g., recording element substrate, to an integrated structure. The patent document is silent on problems including vibration transmission to the outer surface of an ink tank housing, although describing prevention of deformation of the ink tank itself.

Another method winds a vibration-absorbing material or the like around an ink tank box, which is made of a filler-containing material, to prevent transmission of the vibration from the upper side of the ink tank to which a lid is bonded to a recording element substrate on the bottom surface of the ink tank, via the box outside. This method, although capable of reducing the transmitted vibration, cannot sufficiently prevent cracking of the substrate, described above.

Therefore, various methods have been adopted to prevent vibration transmission. Some of these methods include reduction of glass fiber content; changing the material itself; bonding a recording element substrate after a lid is bonded; unitization of recording element substrates, which are bonded by calking under heating after they are incorporated; and fixing a substrate by an adhesive agent. A method which bonds a recording element substrate after a lid is bonded may have limited applicable adhesive agents. A method which unitizes recording element substrates may need substrates of larger size, which can push up the cost.

SUMMARY OF THE INVENTION

The present invention is developed in consideration of the actual situations, described above. It is an object of the present invention to provide a method for producing an ink jet recording cartridge which can be integrated with a recording element substrate precisely without causing any damage on the substrate, has a high barrier capacity, and can work with various inks.

It is another object of the present invention to provide a method for producing an ink jet recording cartridge provided with a recording element substrate on the bottom surface, comprising steps for pressing a lid to an upper opening of an ink-holding container made of a resin material including glass fibers to cover the opening, and for vibration welding where means for holding the lid is vibrated in the direction along the top surface of the container to weld the lid to the container.

BRIEF DESCRIPTION OF THE DRAWINGS

FIGS. 3A, 3B, 3C, 3D, 3E, and 3F each show size of the recording device on which an embodiment of the ink jet recording cartridge of the present invention is mounted.

DETAILED DESCRIPTION OF THE PREFERRED EMBODIMENTS

Next, the preferred embodiments of the present invention are described by referring to the attached drawings.

The ink jet recording cartridge described below has the ink tank 4, which is a container made of a resin material of high barrier capacity, e.g., a material including glass fibers to prevent evaporation of ink; lid 7 for closing the upper opening of the tank 4; and recording element substrate 2, attached to the bottom surface of the tank 4 as the side opposite to the upper opening, for discharging ink. The ink jet recording cartridge discharges ink from the recording element substrate 2 in the direction essentially in parallel to the direction in which the lid 7 is pressed to the upper opening of the tank 4 to close the opening.

Figure 1:
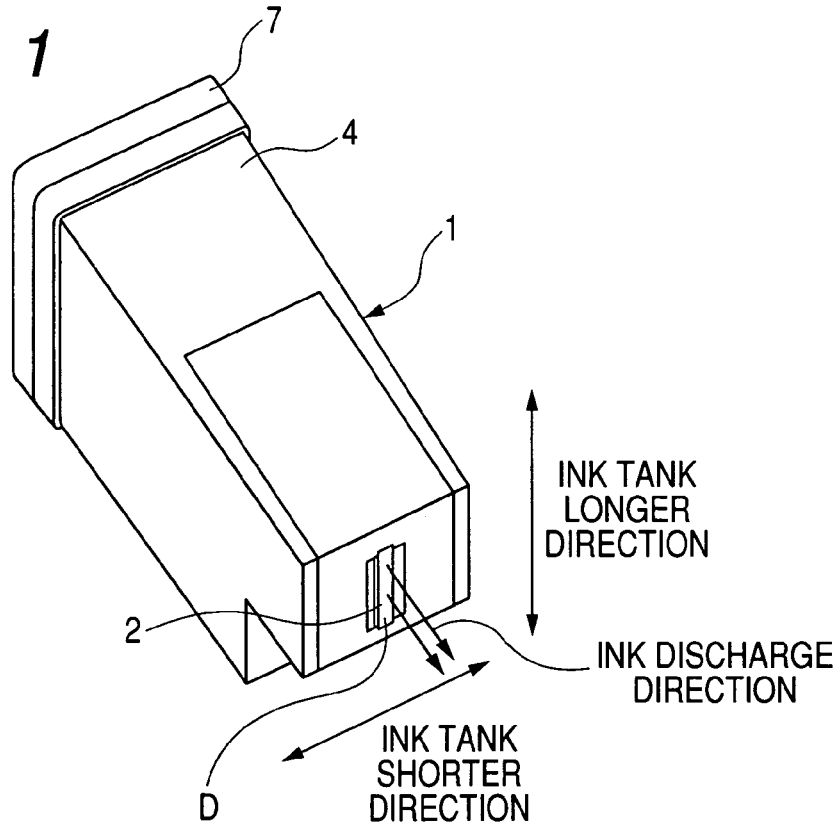
FIG. 1 is an oblique view showing features of an embodiment of the ink jet recording cartridge of the present invention.

FIG. 1 is an oblique view showing features of an embodiment of the ink jet recording cartridge of the present invention.

As shown in FIG. 1, the ink jet recording cartridge 1 has the recording element substrate 2 provided with an ink-discharging function of discharging ink droplets onto a recording sheet, e.g., paper, for recording; ink tank 4 containing an ink-absorbing member which absorbs and holds the liquid ink; and lid 7 which closes the ink tank opening after the ink-absorbing member is put in the tank.

The recording element substrate 2 is bonded, by an adhesive agent, to one end face of the ink tank 4, so that it is opposed to the opening of the ink tank. Ink is injected into the ink-absorbing member inserted in the ink tank 4.

The "ink tank longer direction" and "ink tank shorter direction" are shown in FIG. 1 by the arrows. These directions are defined as those in which the longer and shorter edges extend, respectively, in a plan view of the ink tank 4. Both directions are in parallel to the top surface of the ink tank 4, and also to the ink-discharging port D plane on the recording element substrate 2. The "ink discharge direction" is at a right angle to the ink-discharging port D plane, running in the direction different from the "ink tank longer direction" or "ink tank shorter direction." In FIG. 1, the "ink discharge direction" is at a right angle to the "ink tank longer direction" and to the "ink tank shorter direction."

Figure 2:
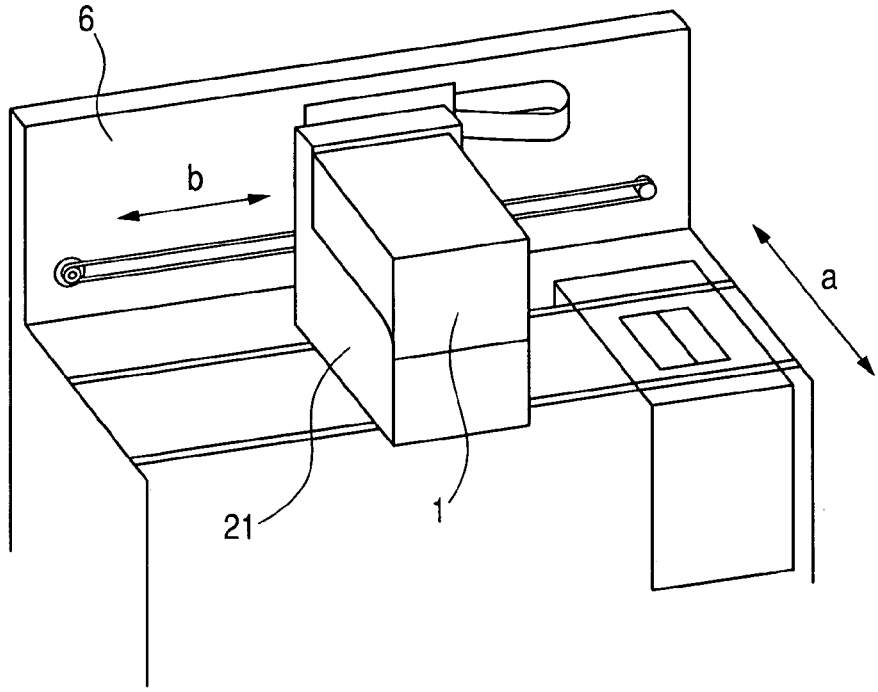
FIG. 2 schematically illustrates an ink jet recording cartridge on which an embodiment of the ink jet recording cartridge of the present invention is mounted.

FIG. 2 is an oblique view outlining an ink jet recording device on which one or more ink jet recording cartridges 1 are mounted. The ink jet recording device 6 shown in FIG. 2 is provided with the carriage 21 by which the ink jet recording cartridge 1 can be freely attached to, or detached from, the device. The carriage 21 is scanned in a direction intersecting with the recording sheet transferring direction "a," e.g., at a right angle.

The recording element substrate 2 is located in the ink tank 4 so as that its longer direction extends along (e.g., in parallel to) the recording sheet transferring direction "a" and to intersect with the carriage scanning direction "b" (e.g., at a right angle).

The ink tank 4 is structured to have the longer direction extending along the longer direction of the recording element substrate 2. The recording element substrate 2 generally has a length increasing as the number of nozzles increases. The ink tank 4 extends almost in parallel to the longer direction of the recording element substrate 2 to suppress length of the scanning travel of the carriage 21 by which the ink jet recording cartridge 1 is mounted, because the recording element substrate 2 of rectangular shape is bonded to the ink tank 4.

FIGS. 3A to 3F outline the ink jet recording device 6 capable of recording images on a recording sheet of up to A-4 size, where it is provided with the ink jet recording cartridge 1 of the same volume. FIGS. 3A and 3B each shows the ink tank and ink jet recording device on which the tank is mounted, where the longer direction of the ink tank box extends in parallel to the carriage scanning direction "b." FIGS. 3C and 3D each show the ink tank and ink jet recording device on which the tank is mounted, where the longer direction of the ink tank box extends at a right angle to the carriage scanning direction "b." FIGS. 3E and 3F each show the ink tank and ink jet recording device on which the tank is mounted, where the longer direction of the ink tank box extends at a right angle to the carriage scanning direction "b," but vertical to the paper. The configurations shown in FIGS. 3A and 3B need a wider space than the ink jet recording cartridge 1 in the carriage scanning direction by an allowance for an A-4 width (recording sheet width). Therefore, the cartridge is designed to extend perpendicularly or vertically to the carriage scanning direction, as shown in FIGS. 3C or 3E, to minimize the device width.

Figure 4:
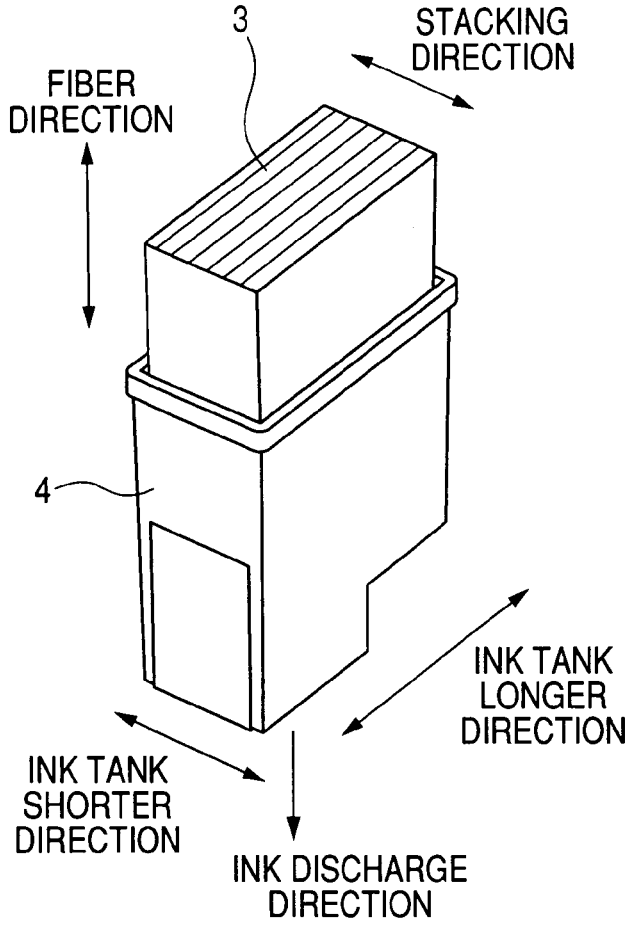
FIG. 4 schematically illustrates the fiber direction in, and stacking direction of, an ink-absorbing member used in an embodiment of the ink jet recording cartridge of the present invention.

The ink tank 4 holds the ink-absorbing member 3, which is a laminate of fiber bundles, put in through the opening opposite to the recording element substrate 2, as shown in FIG. 4. In this embodiment, the ink tank 4 is 40 mm or more in height, and fibers are directed in parallel to the ink discharge direction and laminated perpendicularly to the ink tank longer direction, to compress the ink-absorbing member 3 in the ink tank shorter direction while it is being inserted.

Given ink is injected into the ink-absorbing member 3 after it is put in the ink tank 4, and the lid 7, shown in FIG. 1, is bonded by vibration welding to close the opening of the ink tank 4.

Figure 5:
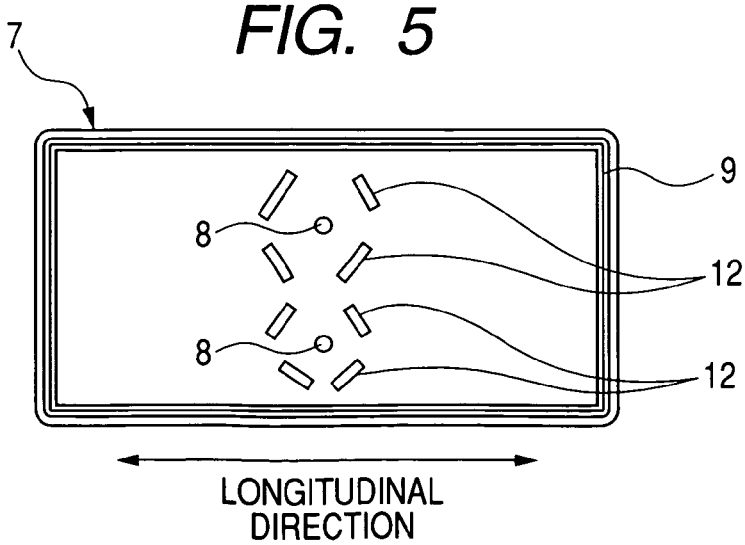
FIG. 5 schematically illustrates the back surface of a lid for an embodiment of the ink jet recording cartridge of the present invention.

The lid has almost the same size as the opening of the ink tank 4, and is provided with air-communicating ports 8 by which the inside of the tank 4 is in communication with the atmospheric air and also with a 0.5 mm-wide, elongated, almost rectangular director 9 for transmitting energy while the lid is bonded, located on the plane facing the opening's outer periphery to project by around 0.3 mm towards the ink discharge direction (refer to FIG. 5).

The vibration welding adopted in the embodiment can give a uniform amplitude to the sliding plane, unlike the above-described ultrasonic, horizontal vibration, and will not cause uneven welding, although generating similarly horizontal vibration.

Vibration Welding

Figure 6B:
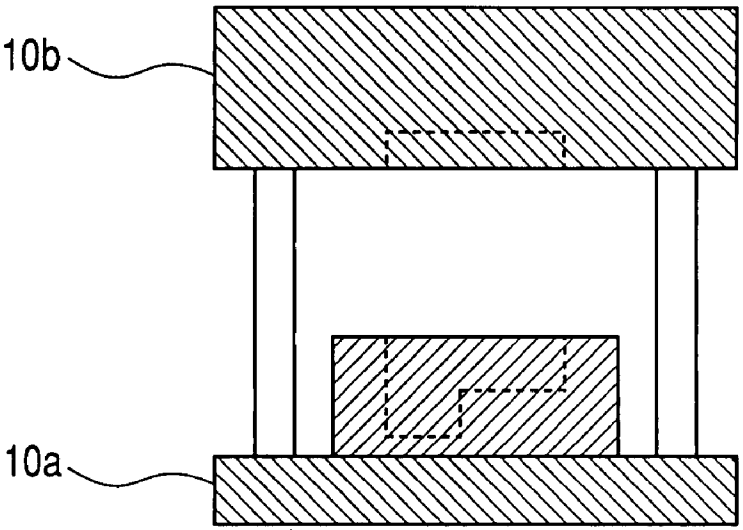
FIGS. 6A and 6B schematically illustrate a vibration welder used for welding a lid for an embodiment of the ink jet recording cartridge of the present invention.
Figure 6A:
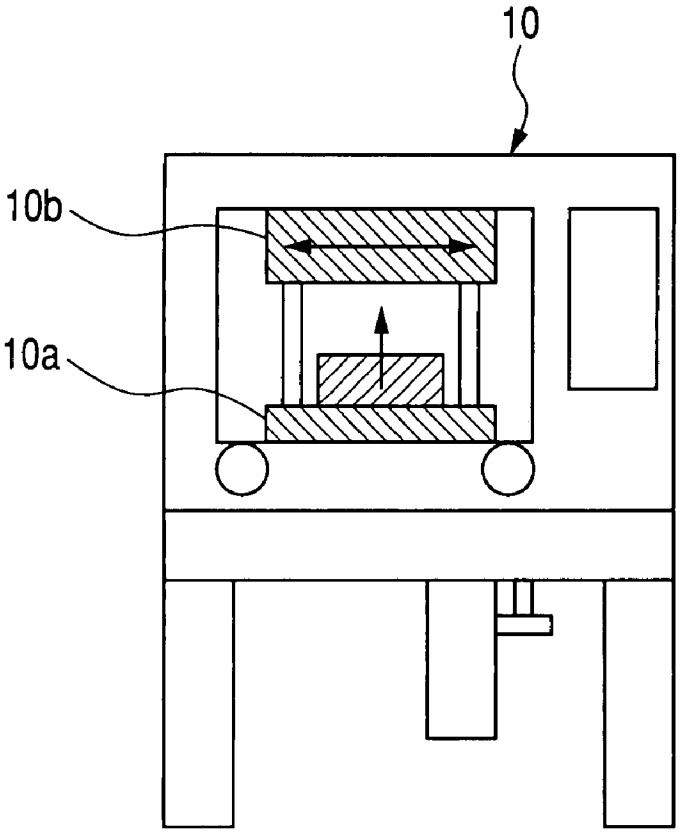

FIG. 6A is a side view of the vibration welder used in this embodiment, and FIG. 6B is an enlarged view schematically illustrating the jig used for the welder shown in FIG. 6A.

As shown in FIGS. 6A and 6B, the vibration welding is carried out after the ink tank 4 is fixed in the cavity (shown by the dotted line) of the receiving jig 10*a* for the vibration welder 10, and the lid 7 is held under a vacuum in the cavity (also shown by the dotted line) of the receiving jig 10*b* located on the vibration welder 10.

In the conventional vibration welding, it is necessary to prevent the jig 10*b* on the vibration member (corresponding to the lid 7 in this embodiment) side and lid 7 from moving from each other by almost fitting a projection on the jig 10*b* into a cavity in the lid 7. However, no fitting means is required in this embodiment, where the lid 7 has a high dimensional accuracy on the exteriors because it is made of a noryl-based resin compounded with a glass filler, and can prevent deformation while being vibrated. The area in which the cavity is provided can serve as a buffer space for the ink tank.

Next, the vibration welding adopted in the embodiment is described.

First, the vibration welding adopted in the embodiment is superior to the conventional technique of ultrasonic welding which uses horizontal vibration taken out from the side of a vertically vibration horn in that it can give uniform vibration to the whole body of the member to be vibrated (lid 7 in this embodiment), and in turn gives the horizontal vibration movement (sliding movement) of the same amplitude to the counterpart member (ink tank 4 in this embodiment). In other words, the vibration welding adopted in the embodiment bonds the lid 7 to the ink tank 4 while vibration them at the same amplitude over the entire contact area. This uniformly bonds the members to each other, even when they are larger than a certain size, without causing uneven welding observed when the conventional technique is adopted.

The welding process is described more specifically by referring to the attached drawings.

Figure 7A:
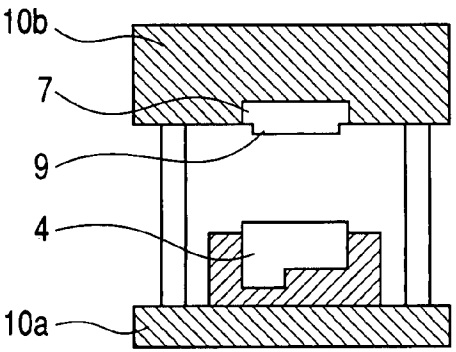
FIGS. 7A, 7B, 7C, 7D, 7E and 7F schematically illustrate the process of welding carried out by the vibration welder shown in FIGS. 6A and 6B.
Figure 7B:
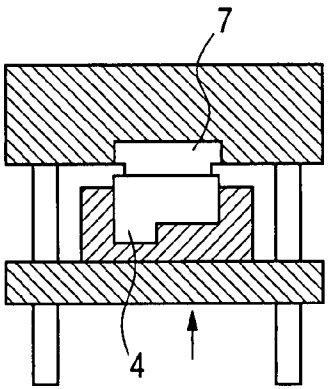

The welding process is triggered, when the jig 10*a* on the ink tank 4 side rises to come into contact with the lid 7 (refer to FIGS. 7A and 7B).

Figure 7C:
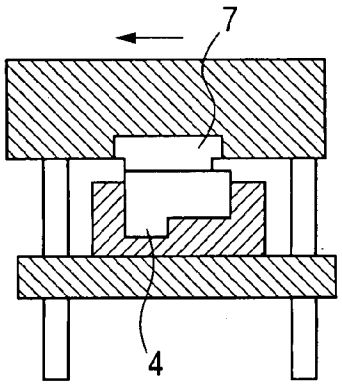
Figure 7D:
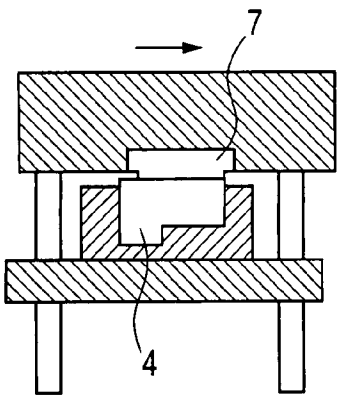

Then, the jig 10*b* on the lid 7 side starts to slide relative to the ink tank 4 in the direction parallel to the director 9 longer direction (refer to FIGS. 7B, 7C and 7D). The longitudinal side of the director 9 and the lid 7 side in contact with the director 9 oscillate at the same amplitude over the entire contact area, because the lid 7 oscillates while being held by the jig 10*b*. In other words, the lid 7 and ink tank 4 slide for the same travel at any contacting point. Therefore, this embodiment should not cause uneven welding, which is observed when ultrasonic horizontal vibration is adopted. Resin temperature increases by friction between the top surface of the ink tank 4 and director 9, making the lid 7 and ink tank 4 compatible with each other in the interface.

Figure 7E:
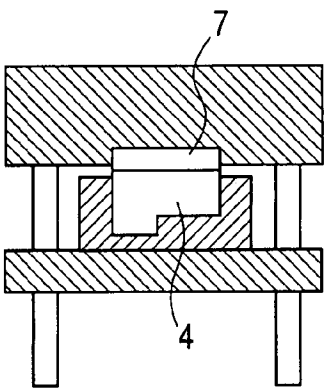

The sliding motion is stopped, when the relative relationship between the lid 7 and ink tank 4 in the direction in parallel to the vibration direction attains a given position and they are welded to a given extent, and cooling of the resin is started (FIG. 7E).

Figure 7F:
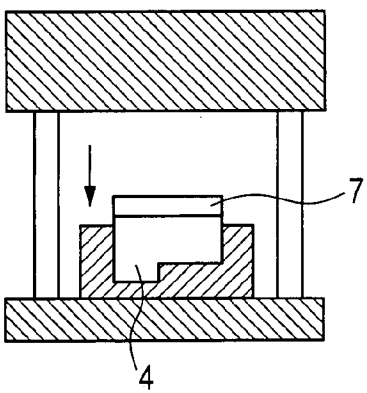

Finally, the jig 10*a* on the ink tank 4 side starts to fall to terminate the work for bonding the lid 7 to the ink tank 4 (FIG. 7F).

Figure 8:
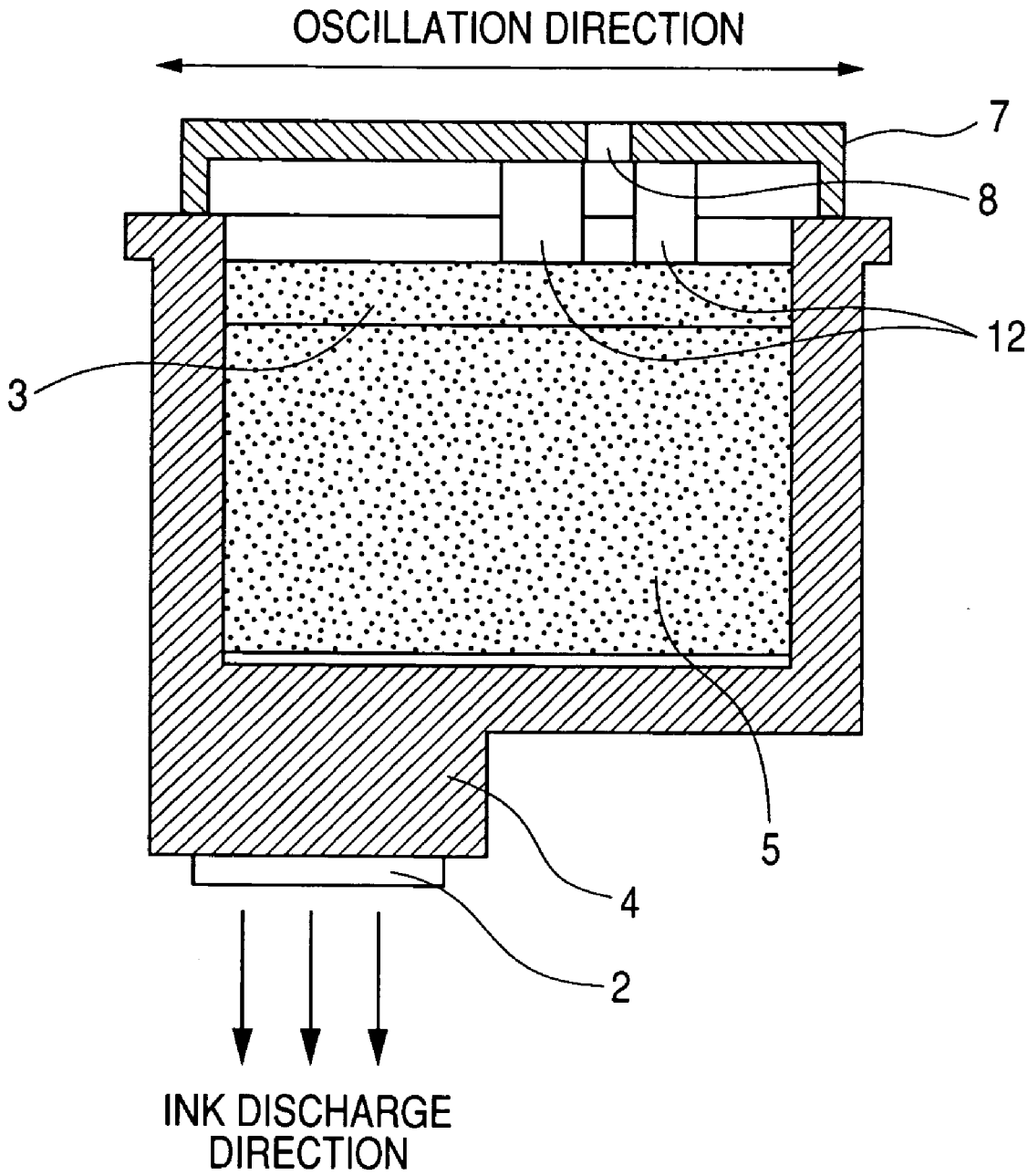
FIG. 8 schematically illustrates the inside of an ink tank vibrated in a manner shown in FIGS. 6A and 6B.

In production of the ink jet recording cartridge 1, the vibration is transmitted to the recording element substrate 2 only in the direction along (in parallel to) the substrate 2 longer direction (ink-discharging port plane), as indicated by the arrow in FIG. 8. As a result, the vibration running from the recording element substrate 2 in the direction along the ink discharge direction to an ink-discharging structure provided on the recording element substrate 2, to avoid cracking of the structure or the like.

Rib For Pressing Ink-Absorbing Member

Figure 9A:
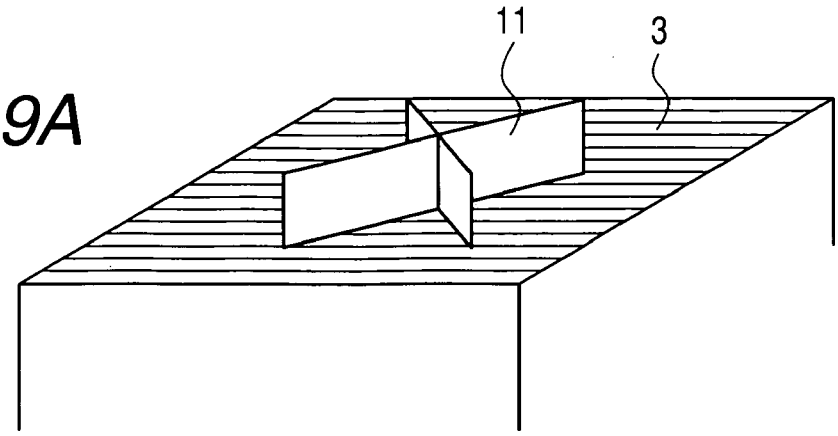
FIGS. 9A, 9B, 9C and 9D schematically illustrate the inside of a conventional, rib-equipped cartridge.
Figure 9B:
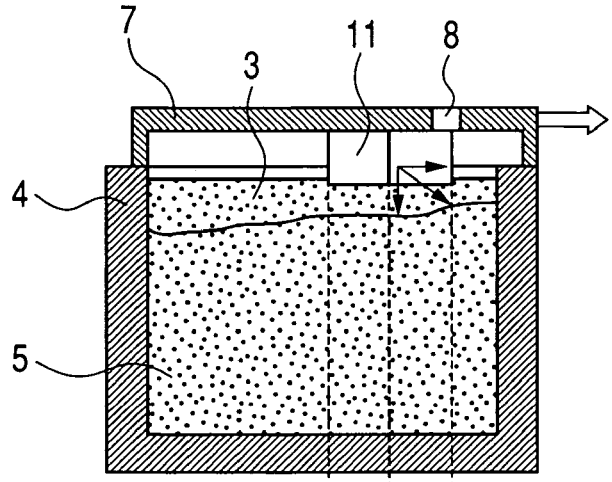
Figure 9C:
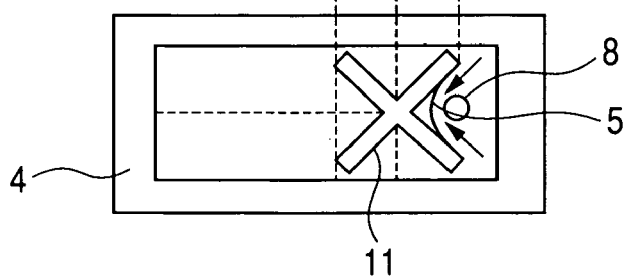

The back surface of the lid 7 (directed inwards to face the ink-absorbing member 3 contained in the ink tank 4) is provided with a projection (rib) to press the ink-absorbing member 3 in the ink tank 4 downwards. For the ink tank disclosed by Japanese Patent Application Laid-Open No. 2003-2-5603, ultrasonic welding with vertical vibration is carried out while the cross rib 11 is pressing the fibrous ink-absorbing member 3 downwards (FIGS. 9A and 9B).

Figure 9D:
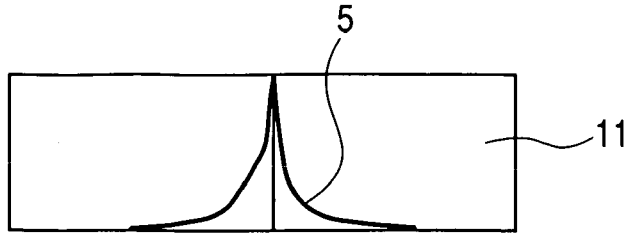

On the other hand, in the embodiment carried out by vibration welding with horizontal vibration, the cross rib 11 slides over the ink-absorbing member 3 with which it is in contact. As a result, the ink-absorbing member 3 containing the ink 5 is subjected to a force for pushing out the ink 5 from the member 5, in addition to the compressive force for melting the director 9, as shown in FIG. 9B. The ink 5 pushed out of the member 3 is again drawn back to the member 3 inside by a capillary force in the member 3 as time passes after the welding is over. At the same time, the ink 5 pushed out of the member 3 is also subjected to a capillary force to move towards the corners in the cross rib 11 and then drawn up (FIG. 9D). This portion of the ink may be driven by the capillary force towards the lid 7 inside, i.e., in the vicinity of air-communicating ports 8, before it is drawn back to the member 3.

This needs some measures, e.g., increasing radius of the cross rib 11 corner to make its angle less sharp, which, however, may decrease an upper space in the cartridge (hereinafter referred to as the "buffer space").

In the embodiment, the pressing rib 12 is provided on the inner side of the director 9, as shown in FIG. 5. It structurally differs from the conventional one in that it has air-communicating ports 8 each within the angles formed by the crossing rib parts. More specifically, a plurality of the pressing ribs 12 are located so as to have each of the air-communicating port 8 in the circle formed by their longitudinal sides.

The welding process is described in more detail by referring to FIGS. 10A to 10E.

Figure 10A:
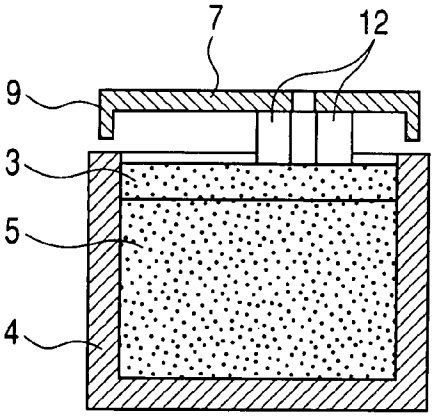
FIGS. 10A, 10B, 10C, 10D and 10E schematically illustrate the vibration rib conditions in an embodiment of the ink jet recording cartridge of the present invention.

The receiving jig for the ink tank 4 rises to bring the ink-absorbing member 3 and pressing ribs 12 into contact with each other at their edges, before the director 9 on the lid 7 comes into contact with the ink tank 4 (FIG. 10A).

The ink-absorbing member 3 has a capillary force increased in the interface with the pressing rib 12, which draws the ink 5 in the member 3 towards the vicinity of the pressing rib 12.

Figure 10B:
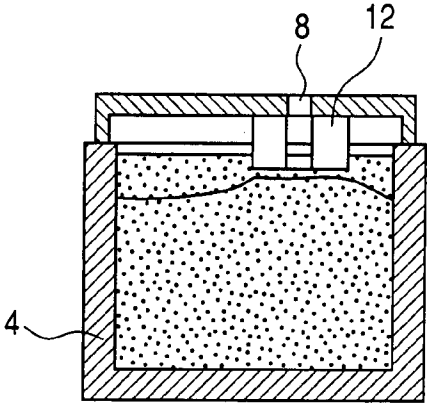

Then, the receiving jig for the ink tank 4 further rises to bring the director 9 on the lid 7 and ink tank 4 into contact with each other. This further draws the ink 5 in the member 3 towards the vicinity of the pressing rib 12 (FIG. 10B).

Figure 10C:
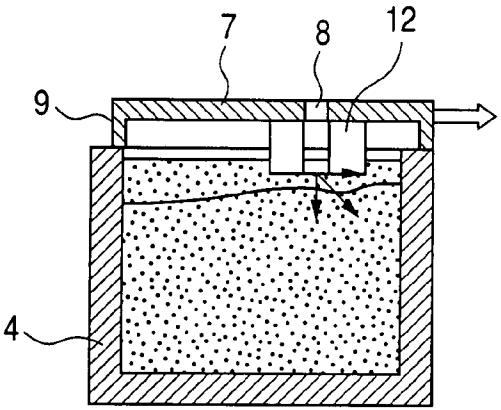

The jig holding the lid 7 starts to slide in parallel to the ink tank 4 longer direction, when the director 9 and ink tank 4 come into contact with each other (FIG. 10C).

As the pressing rib 12 slides, its edge is driven to make inroads into the top surface of the ink-absorbing member 3, which, in turn, drives the vicinity of the top surface of the member 3, into which the edge makes inroads, to slide in the same direction as the edge. As a result, the ink 5 in the member 3 is subjected to a force in addition to the capillary force in the member 3, to be pushed out.

The ink 5 pushed out of the ink-absorbing member 3 is then driven by the jig sliding on the side plane of the pressing rib 12 to move in the direction perpendicular to the vibration direction.

Figure 10D:
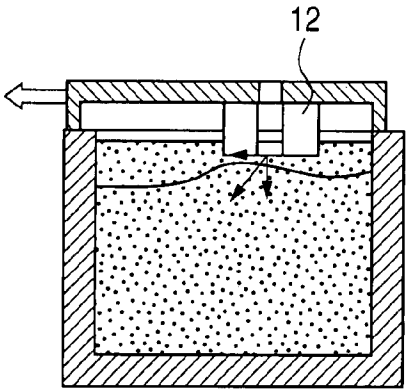
Figure 10E:
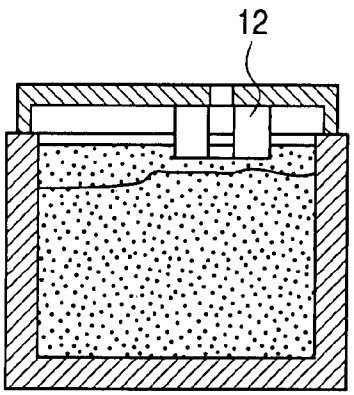

When the sliding direction is reversed, the ink pushed out of the ink-absorbing member 3 before by the sliding motion is held again by a capillary force in the member 3 (FIG. 10D).

Moreover, the ink 5 is pushed out of the circle formed by a plurality of the pressing ribs 12 before the sliding motion is reversed. Reversing the sliding direction reduces quantity of the ink 5 pushed out of the circle, and also prevents the ink 5 from being deposited on the lid 7.

The above forward and reverse motions of the pressing ribs 12 are repeated until the work for bonding the lid 7 to the ink tank 4 is completed.

As described earlier, a plurality of the pressing ribs 12 are located so as to have each of the air-communicating port 8 in the circle formed by their longitudinal sides. Therefore, the ink 5 tends to be contained in the circle by its surface tension working to follow the circle shape. When the ink 5 builds up sufficiently in the circle, it moves downwards, i.e., towards the ink-absorbing member 3, after the meniscus is broken by a gap between the pressing ribs 12, and is retained again by the member 3.

Rib for Regulating Tank Wall

Figure 11A:
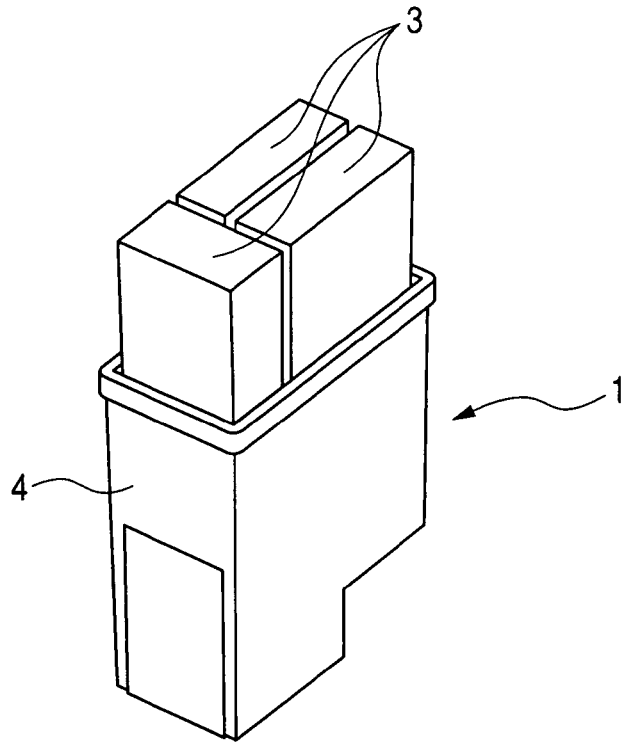
FIGS. 11A and 11B schematically illustrate an embodiment of the ink jet recording cartridge of the present invention, holding 3 types of ink.
Figure 11B:
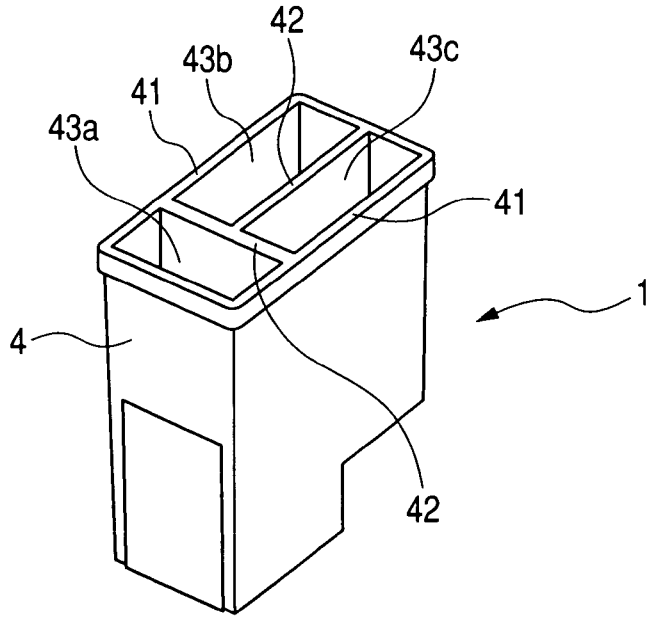

FIGS. 11A and 11B present oblique views illustrating the ink tank 4 as a constituent component of the ink jet recording cartridge 1 of this embodiment. The tank 4 can contain 3 types of ink.

Figure 12:
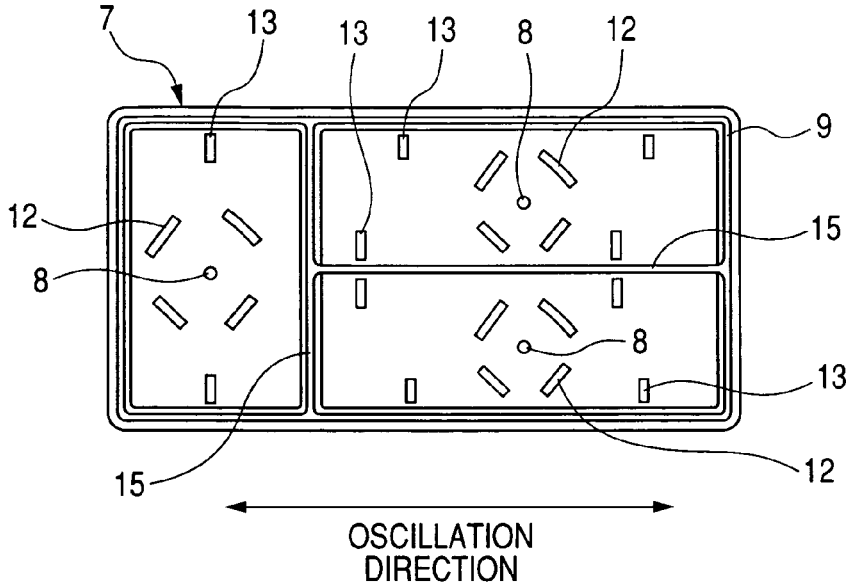
FIG. 12 schematically illustrates the back surface of a lid for an embodiment of the ink jet recording cartridge of the present invention, shown in FIGS. 11A and 11B.
Figure 13:
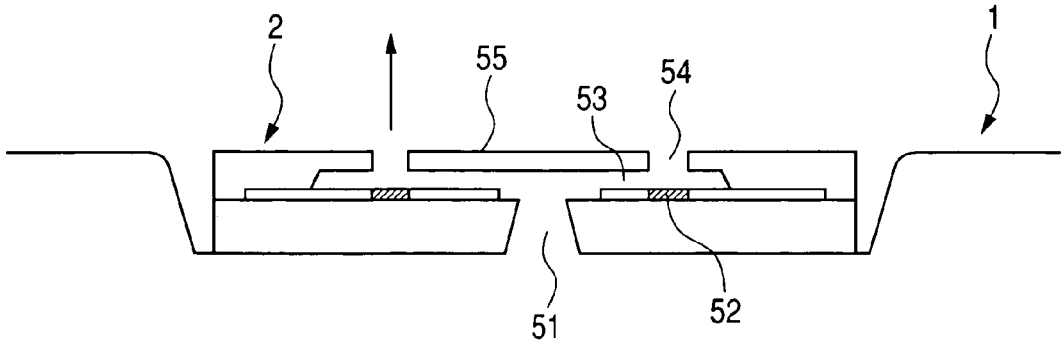
FIG. 13 outlines ultrasonic welding carried out by the aid of a horn of conventional technique.
Figure 14:
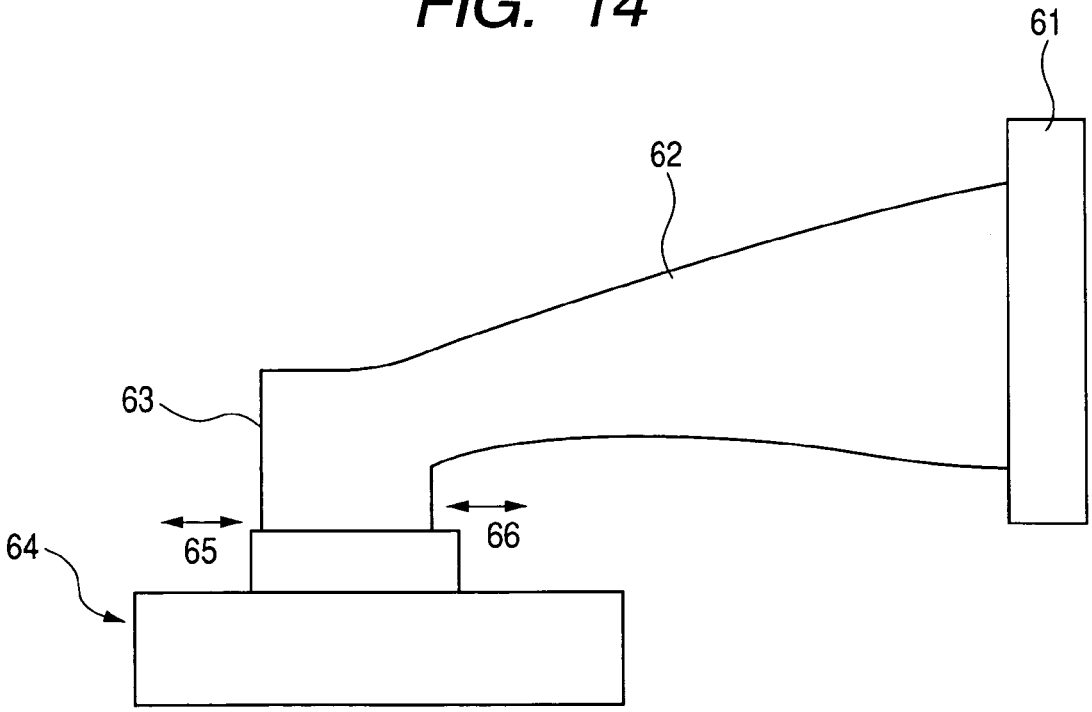
FIG. 14 outlines ultrasonic welding carried out by the aid of a horn of conventional technique.

FIG. 12 is a plan view illustrating the back surface of the lid 7 for the ink jet recording cartridge 1 shown in FIGS. 11A and 11B.

As shown in FIG. 11B, the ink tank 4 has the 3 ink-holding chambers inside, 43*a*, 43*b* and 43*c*, separated from each other by the partition walls 42, where each of the chambers corresponds to the director section on the lid 7 shown in FIG. 12 (the director 9 and partition rib 15 concertedly work as the director). As shown in FIG. 12, the partition ribs 15 are provided on the lid 7, each corresponding to the upper end of the partition wall 42. The partition rib 15 works as part of the director 9, sliding on the upper end of the partition wall 42 while the vibration welding is carried out.

Arranging the ink-absorbing members 3, each for retaining ink, e.g., of yellow, magenta or cyan, in parallel to the vibration direction will increase size of the ink jet recording cartridge 1, and hence size of the ink jet recording device 6.

In this embodiment, the ink tank 4 is divided to have an almost T-shaped section, like the ink tank disclosed by Japanese Patent No. 2,887,058, with the partition wall 42 running perpendicularly to the vibration direction being designed to be thicker than that running in parallel to the vibration direction. This configuration will allow thickness of the ink tank 4 in the carriage scanning direction to be essentially on par with that of the tank produced by ultrasonic welding.

Moreover, the lid 7 is also provided with the regulating ribs 13 on the back surface, as shown in FIG. 12. The rib 13, different from the pressing rib 12 for pressing the ink-absorbing member 3, works to prevent the side wall 41 or partition wall 42 of the ink tank 4 from being displaced in a direction other than the intended sliding direction during the vibration welding, otherwise the wall 41 or 42 may be more easily displaced in a direction intersecting with the sliding direction, when the ink tank 4 and lid 7 are sliding in a direction almost perpendicular to the direction in which they are pressed to each other. In particular, the thinner partition wall 42 tends to be more deformed. Deformation of the wall 41 or 42 may obstruct smooth welding of the members in a sliding motion. Therefore, the regulating ribs 13 are provided on both sides of the partition wall 42 arranged along the sliding (vibration) direction, to prevent the wall 42 from being displaced in a direction other than the sliding direction. The regulating rib 13 and partition wall 42 stand close to each other, although not in contact, while they remain stationary.

Others

The embodiment adopts vibration welding carried out along the ink tank 4 longer direction for the ink jet recording cartridge 1 supporting, on the bottom surface, the recording element substrate 2 whose longer direction extends along the ink tank 4 longer direction. Moreover, the ink jet recording cartridge 1 is mounted on the carriage 21 so as that its longer direction is at a right angle to the carriage scanning direction.

However, the ink tank 4 may be vibrated in the shorter direction, when its wall is deformed to a limited extent, or within an allowable range. In the above design, it is recommended that a plurality of the pressing ribs 12 provided on the back surface of the lid 7 are located so as to have each of the air-communicating port 8 in the circle formed by them, as is the case with the vibration along the longer direction. It is also recommended that the regulating rib 13 is provided at a position close to the ink tank wall side extending in the shorter direction to prevent the wall extending in the vibration direction, i.e., in the shorter direction, from being displaced in the longer direction.

The ink jet recording cartridge 1 may have a structure with the recording element substrate 2 whose longer direction is along the shorter direction of the ink tank 4. No vibration is transmitted to the recording element substrate 2 in the ink discharge direction (i.e., the direction along the ink-discharging port plane on the recording element substrate). It is therefore apparent that cracking can be avoided also in the above design.

In the embodiment, the cartridge box is made of a noryl-based resin compounded with around 25% of glass filler. However, the resin material for the cartridge box and its glass filler content are not limited to the above. The present invention, when applied to a cartridge box structure which easily allows vibration it receives on the top surface to transmit to the bottom surface, brings an advantage of effectively preventing damages, e.g., cracks, on the recording element substrate 2.

The embodiment described above bonds the ink tank opening to the lid for closing the opening by vibration welding, where the vibration moves along the ink-discharging port plane on the recording element substrate, to produce the ink jet recording cartridge without leaving fatal defects in the recording element substrate. Moreover, it can avoid damages on the recording element substrate, even when filler content is increased to improve gas barrier capacity of the ink tank, which allows vibration to transmit more easily to the ink-discharging structure. Therefore, it can provide an ink jet recording cartridge which can prevent evaporation of ink more effectively.

This application claims priority from Japanese Patent Application No. 2004-203283 filed Jul. 9, 2004, which is hereby incorporated by reference herein.

What is claimed is:

1. A method for producing an ink jet recording cartridge provided with a recording element substrate on a surface of an ink-holding container thereof, comprising the steps of:

pressing a lid to an opening of the ink-holding container which is made of a resin material including glass fibers so as to cover the opening, said opening being provided on a surface opposed to the surface provided with the recording element substrate; and vibration welding the lid to the container wherein means for holding the lid is vibrated with the same amplitude in an entire contact area of the lid and the container in the direction along the top surface of the container.

2. The method according to claim 1, wherein the recording element substrate is integrated with the container so as to keep the longer direction of the recording element substrate parallel to the longer direction of the top surface of the container.

3. The method according to claim 1, wherein an ink-absorbing member is contained in the container, and the lid is provided, on a surface thereof facing the ink-absorbing member, with a plurality of ribs surrounding an air-communicating port(s) so that the ribs press the ink-absorbing member into contact.

4. The method according to claim 3, wherein the ribs are arranged so as to surround the air-communicating port(s) by their sides each along an extended direction.

5. The method according to claim 1, wherein the lid is provided, on the back surface, with a rib(s) for preventing a partition wall(s), by which the inside of the container is divided into a plurality of chambers, from being displaced in a direction other than the vibration direction.

* * * * *

UNITED STATES PATENT AND TRADEMARK OFFICE

CERTIFICATE OF CORRECTION

PATENT NO. : 7,396,118 B2
APPLICATION NO. : 11/174566
DATED : July 8, 2008
INVENTOR(S) : Masashi Ogawa et al.

It is certified that error appears in the above-identified patent and that said Letters Patent is hereby corrected as shown below:

COLUMN 4

Line 52, “as” should be deleted.

COLUMN 6

Line 4, “vibration” should read --vibrating--;
Line 10, “vibration” should read --vibrating--; and
Line 56, “No. 2003-2-5603,” should read --No. 2003-25603,--.

COLUMN 7

Line 18, “port” should read --ports--; and
Line 60, “port” should read --ports--.

COLUMN 8

Line 57, “as” should be deleted.

Signed and Sealed this

Third Day of March, 2009

John Doll

JOHN DOLL
*Acting Director of the United States Patent and Trademark Office*

UNITED STATES PATENT AND TRADEMARK OFFICE

CERTIFICATE OF CORRECTION

PATENT NO. : 7,396,118 B2
APPLICATION NO. : 11/174566
DATED : July 8, 2008
INVENTOR(S) : Masashi Ogawa et al.

It is certified that error appears in the above-identified patent and that said Letters Patent is hereby corrected as shown below:

COLUMN 10

Line 9, "surface opposed" should read --second surface opposed--;
Line 14, "the top surface" should read --the second surface--; and
Line 18, "the top surface" should read --the second surface--.

Signed and Sealed this

Twenty-eighth Day of July, 2009

John Doll

JOHN DOLL
*Acting Director of the United States Patent and Trademark Office*